US010396505B2

(12) United States Patent
Chang et al.

(10) Patent No.: US 10,396,505 B2
(45) Date of Patent: Aug. 27, 2019

(54) FILTER CONNECTOR

(71) Applicants: U.D.ELECTRONIC CORP., Taoyuan (TW); U.D.(DONGGUAN) ELECTRONIC TECHNOLOGY CORP., Dongguan, Guangdong Province (CN); U.D.(ZHONG JIANG) ELECTRONIC CORP., Deyang, Sichuan Province (CN)

(72) Inventors: Chih-Kai Chang, Taoyuan (TW); Bin Zeng, Taoyuan (TW); Yao-Ching Huang, Taoyuan (TW)

(73) Assignees: U.D.ELECTRONIC CORP., Taoyuan (TW); U.D.(DONGGUAN) ELECTRONIC TECHNOLOGY CORP., Guangdong Province (CN); U.D.(ZHONG JIANG) ELECTRONIC CORP., Sichuan Province (CN)

( * ) Notice: Subject to any disclaimer, the term of this patent is extended or adjusted under 35 U.S.C. 154(b) by 0 days.

(21) Appl. No.: 16/122,822

(22) Filed: Sep. 5, 2018

(65) Prior Publication Data

US 2019/0089101 A1 Mar. 21, 2019

(30) Foreign Application Priority Data

Sep. 20, 2017 (CN) ..... 2017 2 1206294 U
Sep. 20, 2017 (CN) ..... 2017 2 1207182 U

(51) Int. Cl.
*H01R 13/648* (2006.01)
*H01R 13/66* (2006.01)
(Continued)

(52) U.S. Cl.
CPC ..... *H01R 13/6691* (2013.01); *H01R 13/502* (2013.01); *H01R 13/6581* (2013.01);
(Continued)

(58) Field of Classification Search
CPC ..... H01R 13/6691; H01R 13/6658; H01R 12/71; H01R 13/719; H01R 13/6581;
(Continued)

(56) References Cited

U.S. PATENT DOCUMENTS 3,484,621 A * 12/1969 Hugle ..... G05B 19/063 219/108
4,694,418 A * 9/1987 Ueno ..... G06G 7/14 706/3
(Continued)

*Primary Examiner* — Jean F Duverne

(57) ABSTRACT

A filter connector includes an insulative housing including a docking head and a base member, and an electrical module including a circuit board defining a first lateral side and a second lateral side, a plurality of input terminals mounted in the docking head and bonded to the first lateral side of the circuit board and a plurality of output terminals mounted in the base member and bonded to the second lateral side of the circuit board. Thus, the circuit board is vertically secured between the input terminals, ensuring that the filter connector is small in size, simple in structure, and easy to manufacture, and has a filtering function, thereby greatly improving the electric perform.

4 Claims, 8 Drawing Sheets

(51) Int. Cl.

| | |
|---|---|
| ***H01R 13/719*** | (2011.01) |
| ***H01R 13/502*** | (2006.01) |
| ***H01R 13/6581*** | (2011.01) |
| *H01R 12/71* | (2011.01) |
| *H01R 24/86* | (2011.01) |

(52) U.S. Cl.
CPC ..... *H01R 13/719* (2013.01); *H01R 12/71* (2013.01); *H01R 13/6658* (2013.01); *H01R 24/86* (2013.01)

(58) Field of Classification Search
CPC ..... H01R 13/502; G05B 19/063; G06G 7/14; H05K 1/0204
USPC ..... 439/607.01
See application file for complete search history.

(56) References Cited

U.S. PATENT DOCUMENTS

| | | | | |
|---|---|---|---|---|
| 2011/0237130 | A1* | 9/2011 | Mo | H01R 13/719 439/620.07 |
| 2015/0365069 | A1* | 12/2015 | Durner | H03H 9/02015 333/131 |
| 2018/0351595 | A1* | 12/2018 | Tarui | H05K 1/0204 |

* cited by examiner

FILTER CONNECTOR

BACKGROUND OF THE INVENTION

1. Field of the Invention

The present invention relates to filter connector technology and more particularly to a filter connector, which uses an electric module having small size and simple structure characteristics to ensure that the filter connector is small in size, simple in structure, and easy to manufacture, and has a filtering function, thereby greatly improving the electric perform.

2. Description of the Related Art

Conventional electrical connectors, such as M8 connectors and M12 connectors, are purely mechanical connectors, which are mainly composed of an electrically insulative plastic housing and a plurality of terminals. Connectors composed of such components can only be used for the transmission of low-frequency signals. If these connectors are used for high frequency application, signal transmission stability and signal transmission quality can be damaged. However, high frequency signals must be transmitted between devices under specific requirements. The solution adopted for high-frequency transmission today is to install an electronic filter device in the circuit board. This design inevitably occupies the internal space of the equipment, affecting the circuit layout of the equipment. Therefore, there is a strong demand for a filter connector or a cable connector with a filter function that has a small size and simple structure and that facilitates fabrications.

SUMMARY OF THE INVENTION

The present invention has been accomplished under the circumstances in view. It is therefore the main object of the present invention to provide a filter connector, which uses an electric module having small size and simple structure characteristics to ensure that the filter connector is small in size, simple in structure, and easy to manufacture, and has a filtering function, thereby greatly improving the electric perform.

To achieve this and other objects of the present invention, a filter connector comprises an insulative housing and an electrical module. The insulative housing comprises a docking head, and a base member located at one side of the docking head. The electrical module comprises at least one circuit board, a plurality of input terminals and a plurality of output terminals. Each circuit board comprises a first lateral side and a second lateral side disposed adjacent to each other. Each input terminal comprises an input terminal body, and an input bonding end curved from one end of the input terminal. The input bonding end is bonded to the first lateral side of one circuit board to keep the associating input terminal body in parallel to the second lateral side of the respective circuit board. Each output terminal comprises an output terminal body, and an output bonding end curved from one end of the output terminal body. The output bonding end is bonded to the second lateral side of one circuit board to keep the associating output terminal body in parallel to the first lateral side of the respective circuit board. The input terminal bodies of the input terminals of the electrical module and the output terminal bodies of the output terminals of the electrical module are respectively mounted in the docking head and base member of the insulative housing.

BRIEF DESCRIPTION OF THE DRAWINGS

FIG. 6 FIG. 1 is an oblique top elevational view of a filter connector in accordance with a third embodiment of the present invention.

DETAILED DESCRIPTION OF THE PREFERRED EMBODIMENT

Figure 1:
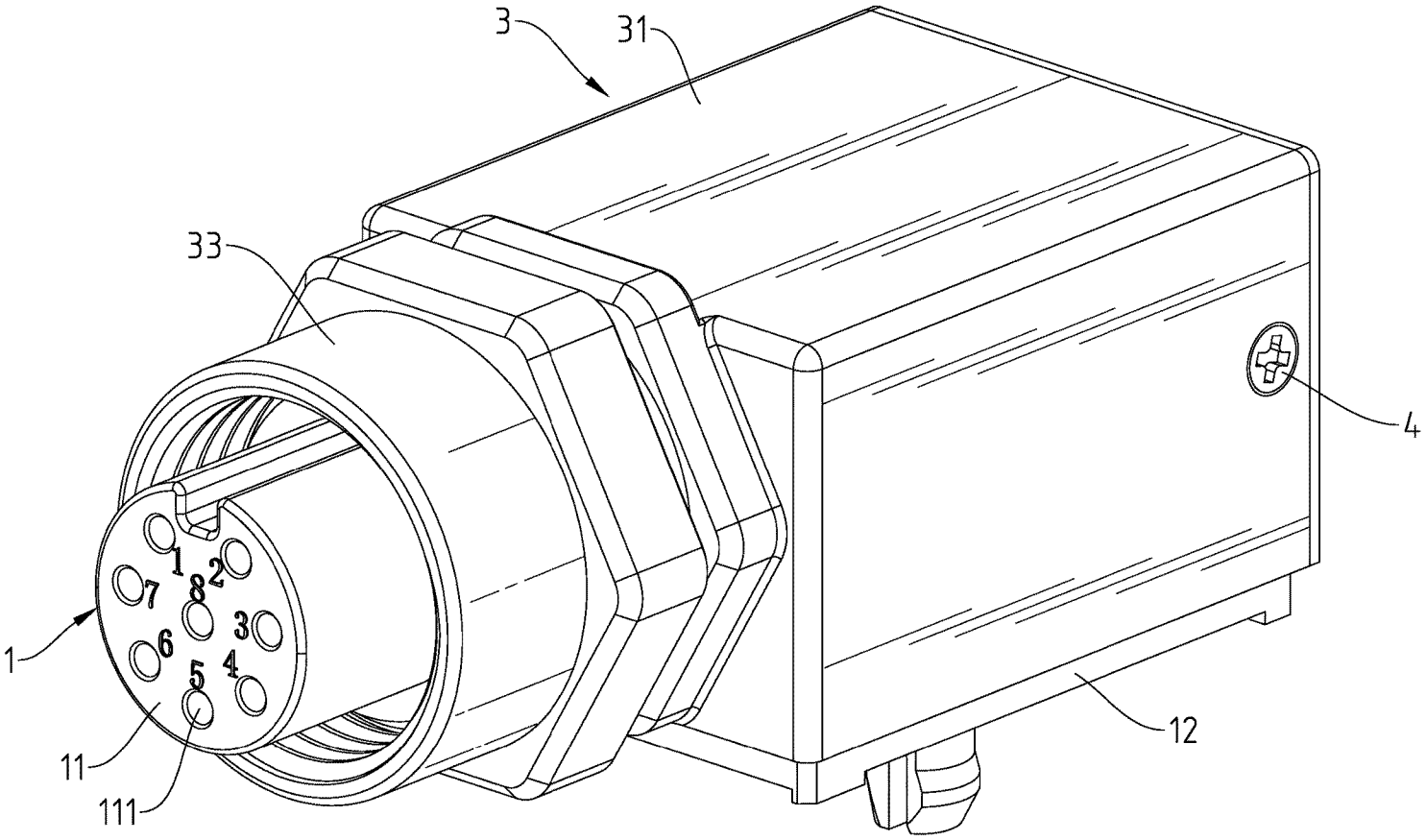
FIG. 1 is an oblique top elevational view of a filter connector in accordance with a first embodiment of the present invention.
Figure 2:
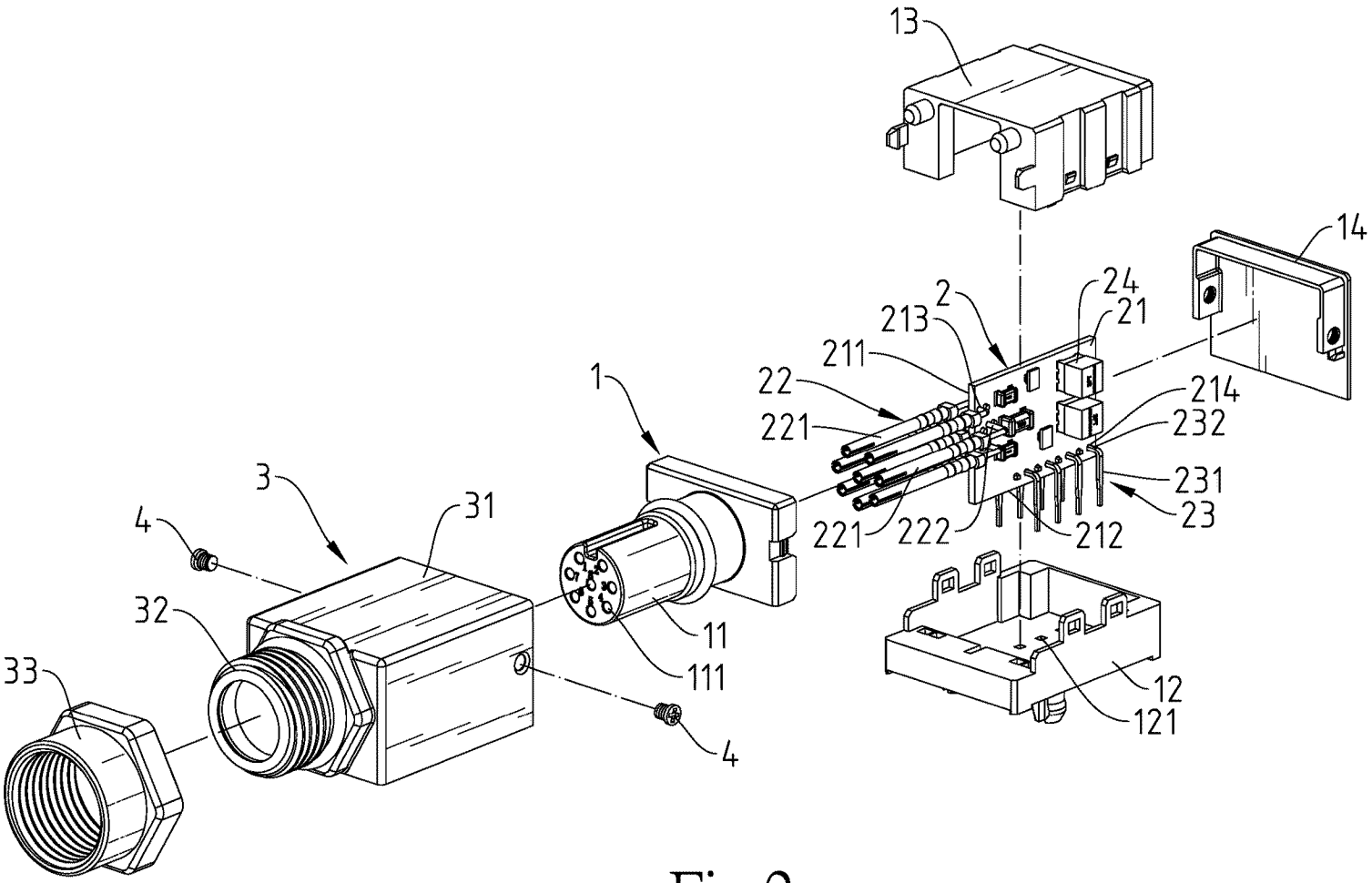
FIG. 2 is an exploded view of the filter connector in accordance with the first embodiment of the present invention.
Figure 3:
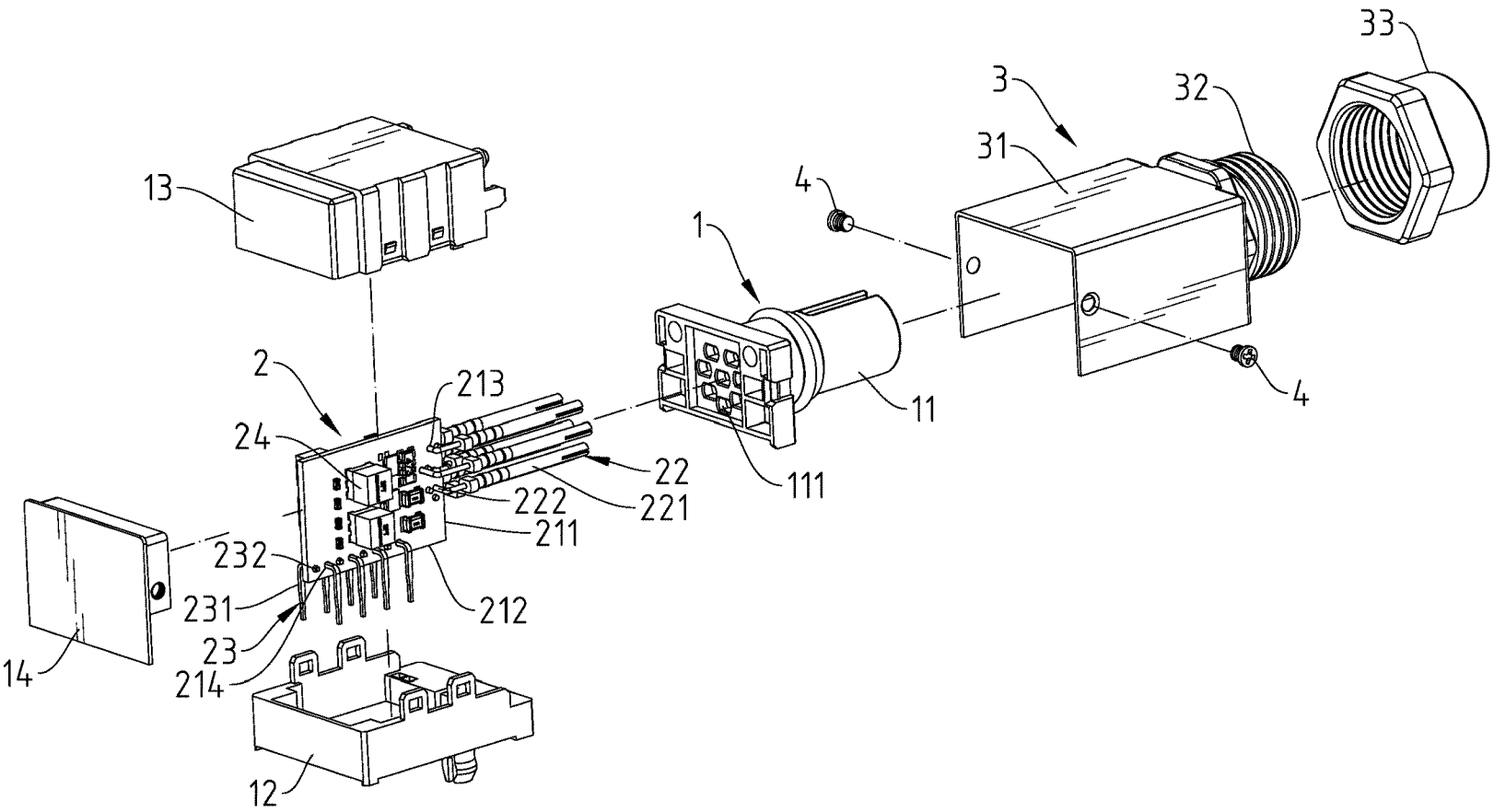
FIG. 3 corresponds to FIG. 2 when viewed from another angle.

Referring to FIGS. 1-3, a filter connector in accordance with a first embodiment of the present invention is shown. The filter connector comprises an insulative housing 1, an electrical module 2 and a shielding shell assembly 3.

The insulative housing 1 comprises a docking head 11, a base member 12, a top cover 13 and a side cover 14. The docking head 11 is made in a cylindrical shape, having a plurality of through holes 111 cut through opposing front and rear ends thereof. The base member 12 comprises a plurality of plug holes 121.

The electrical module 2 comprises a circuit board 21, a plurality of input terminals 22, a plurality of output terminals 23, and a plurality of electronic components 24 (such as: filter, converter, resistor, capacitor, inductor, discharge tube, or high voltage protection component) mounted on the circuit board 21. The circuit board 21 has a first lateral side 211 and a second lateral side 212 disposed adjacent to each other. Each input terminal 22 comprises a input terminal body 221 and an input bonding end 222 curved from one end of the input terminal body 221. The input bonding end 222 is bonded to the first lateral side 211 to keep the input terminal body 221 in parallel to the second lateral side 212. Each output terminal 23 comprises an output terminal body 231 and an output bonding end 232 curved from one end of the output terminal body 231. The output bonding end 232 is bonded to the second lateral side 212 to keep the output terminal body 231 in parallel to the first lateral side 211. Inn this embodiment, first bonding via holes 213 and second bonding via holes 214 are respectively formed on the first lateral side 211 and second lateral side 212 of the circuit board 21 for the bonding of the input bonding ends 222 and the output bonding ends 232 respectively by DIP (dual in-line package).

The shielding shell assembly 3 comprises a shielding shell 31, a mating connection member 32 located at one side of the shielding shell 31, and a locknut 33 fastened to the mating connection member 32.

In installation, mount the input terminal bodies 221 and output terminal bodies 231 of the electrical module 2 in the through holes 111 of the docking head 11 and the plug holes 121 of the base member 12 respectively, then cover the top cover 13 on the top side of the base member 12 and the side cover 14 on the back side of the base member 12 remote from the docking head 11, and thus, the insulative housing 1 and the electrical module 2 are well assembled. Thereafter, mount the insulative housing 1 in the shielding shell 31 of the shielding shell assembly 3 to let the docking head 11 of the insulative housing 1 be accommodated in the mating connection member 32, and then use fastening members 4 to fixedly fasten the insulative housing 1 and the shielding shell assembly 3 together.

Figure 4:
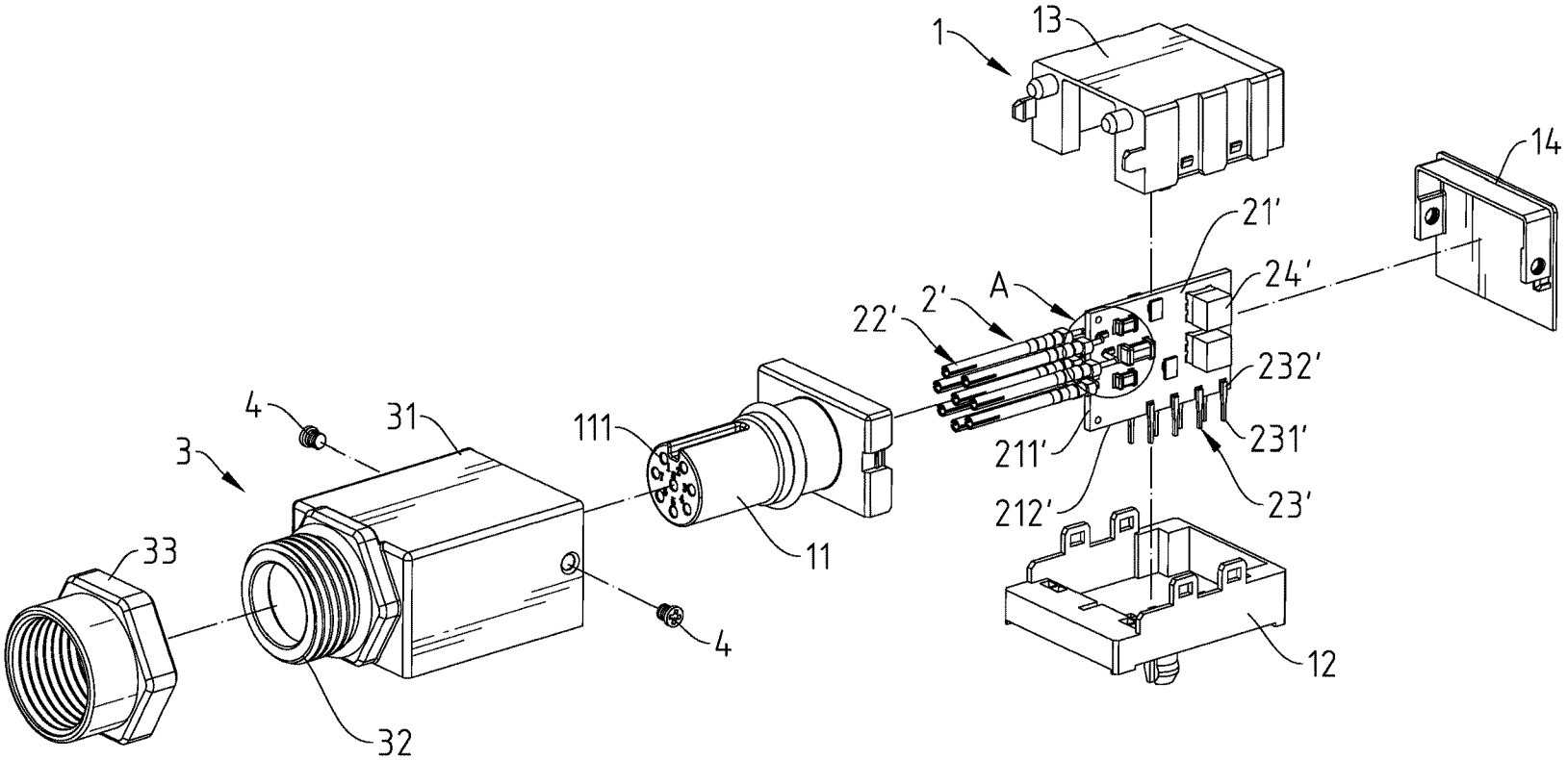
FIG. 4 is an exploded view of a filter connector in accordance with a second embodiment of the present invention.
Figure 5:
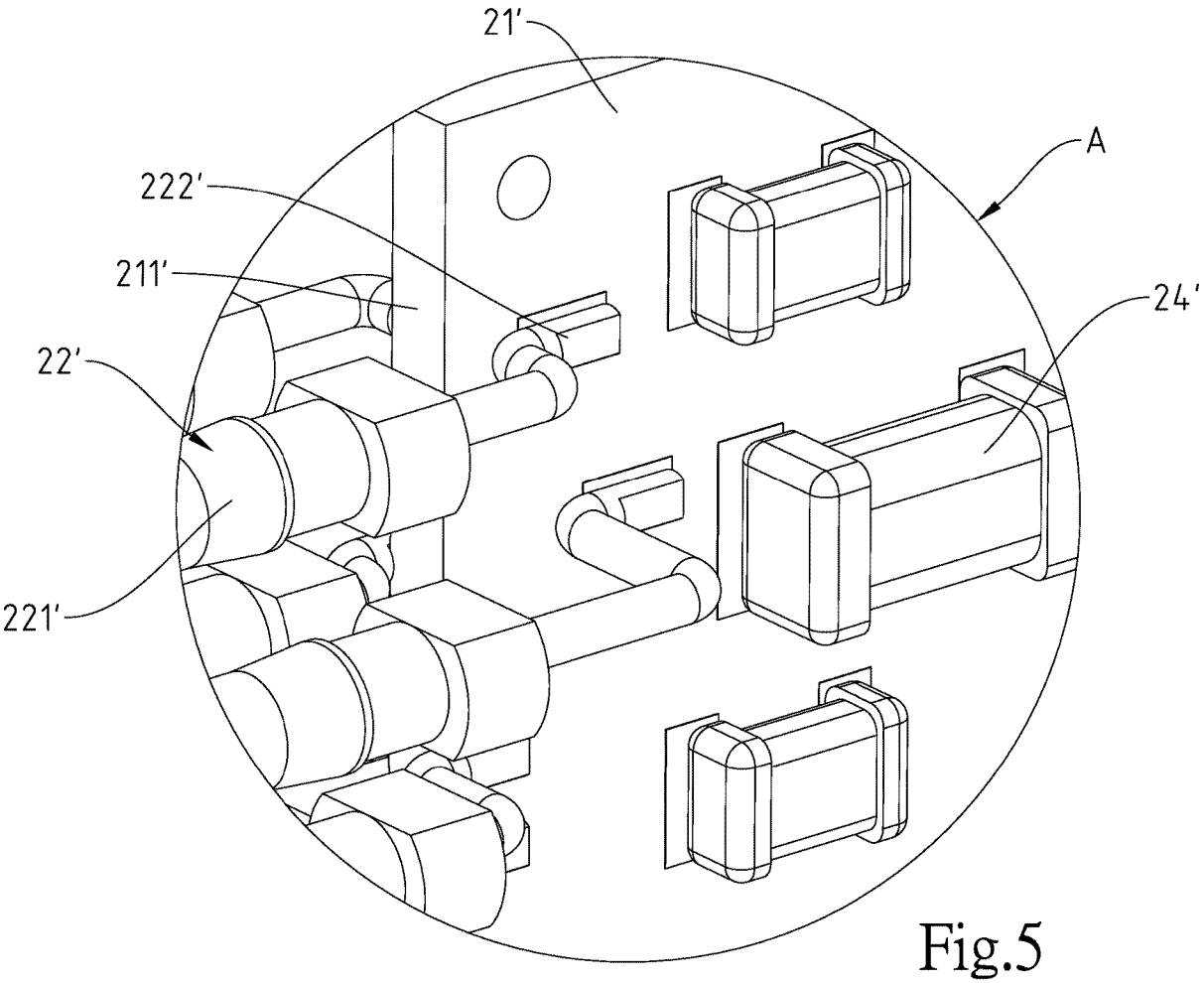
FIG. 5 is an enlarged view of Part A of FIG. 4.

Referring to FIGS. 4 and 5, a filter connector in accordance with a second embodiment of the present invention is shown. This second embodiment is substantially similar to the aforesaid first embodiment with the exception that the input bonding ends 222' of the input terminals 22' and the output bonding ends 232' of the output terminals 23' of the electrical module 2' are respectively electrically bonded to the circuit board 21' using surface mount technology (SMT).

Figure 6:
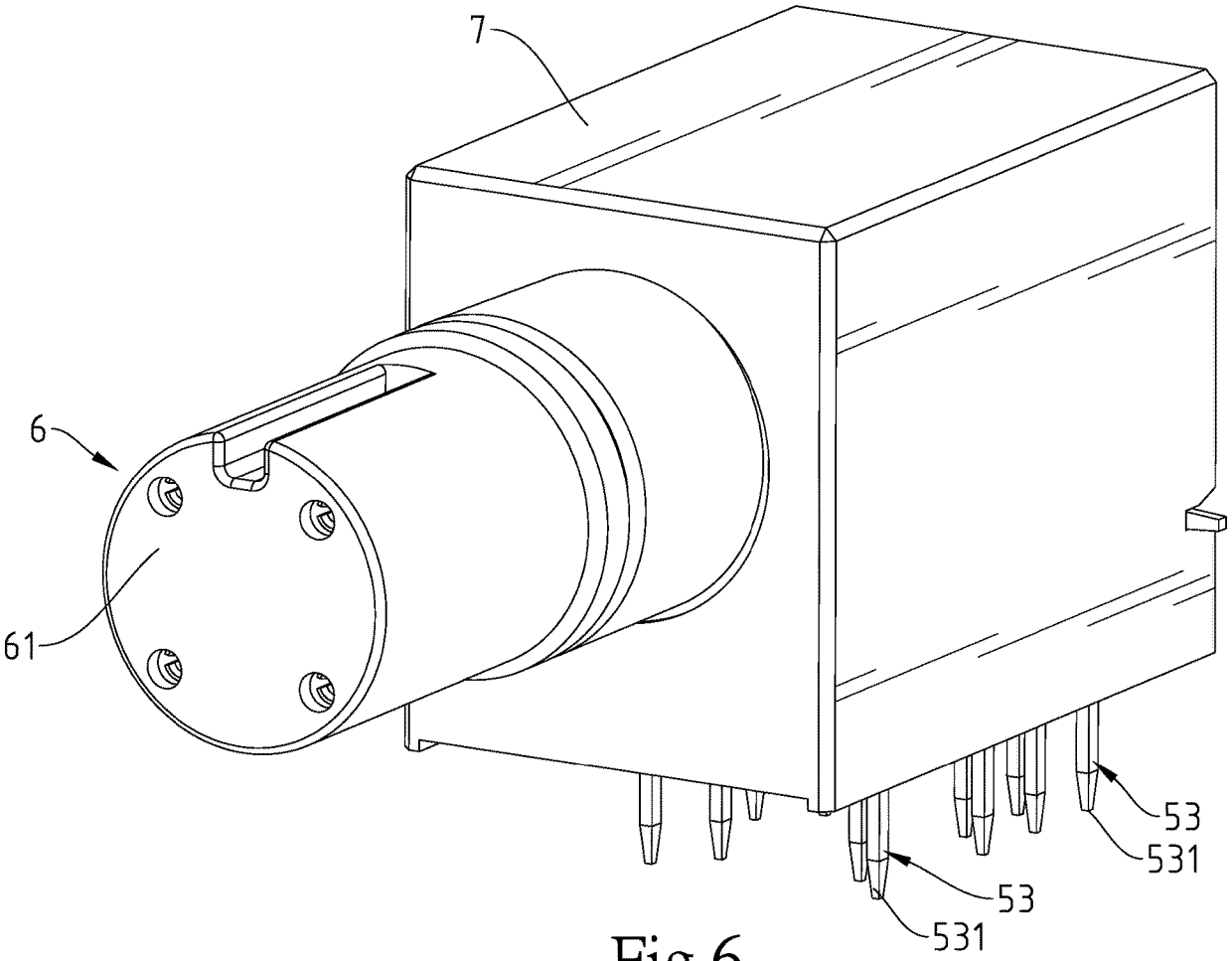
Figure 7:
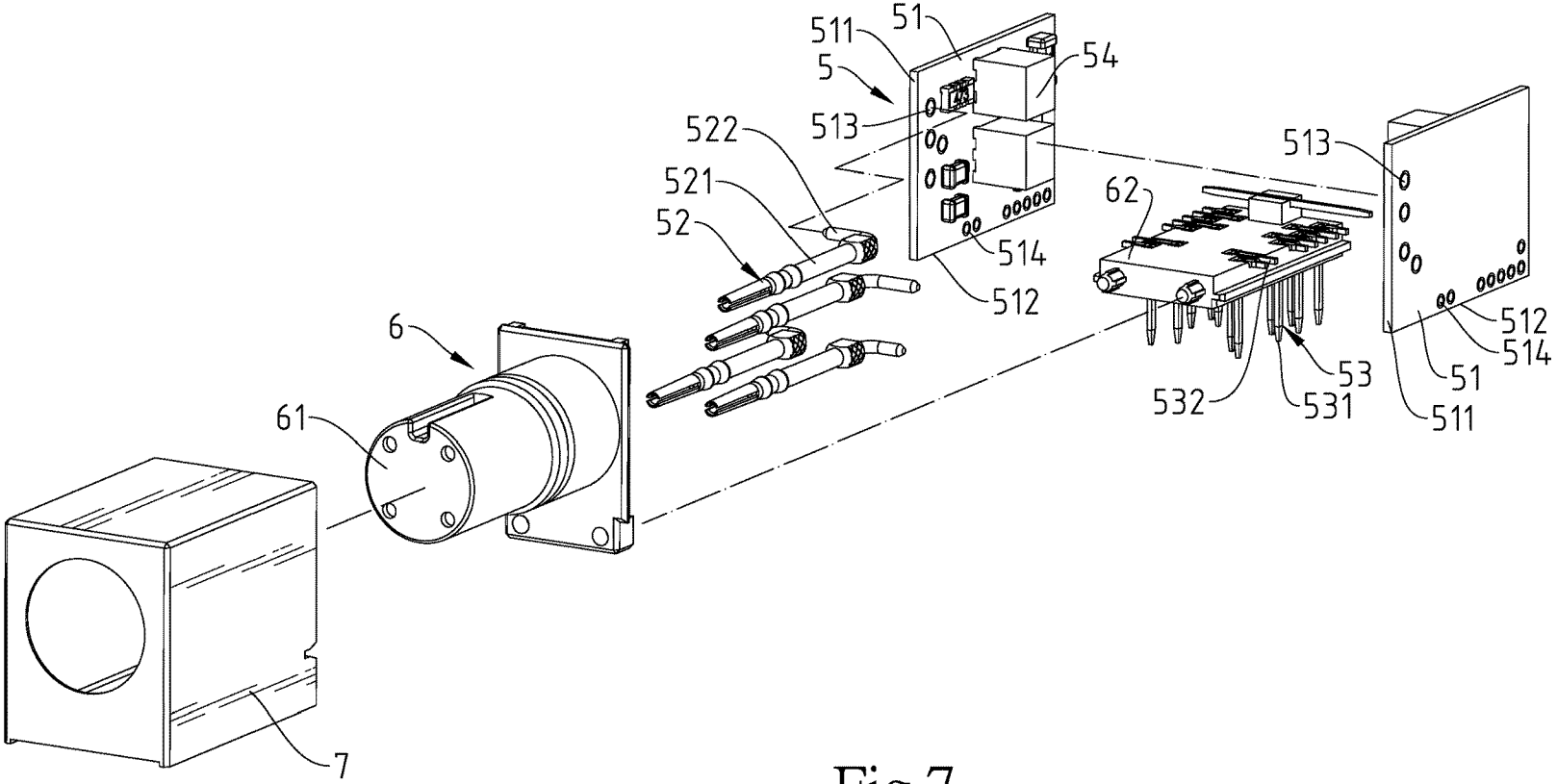
FIG. 7 is an exploded view of the filter connector in accordance with the third embodiment of the present invention.
Figure 8:
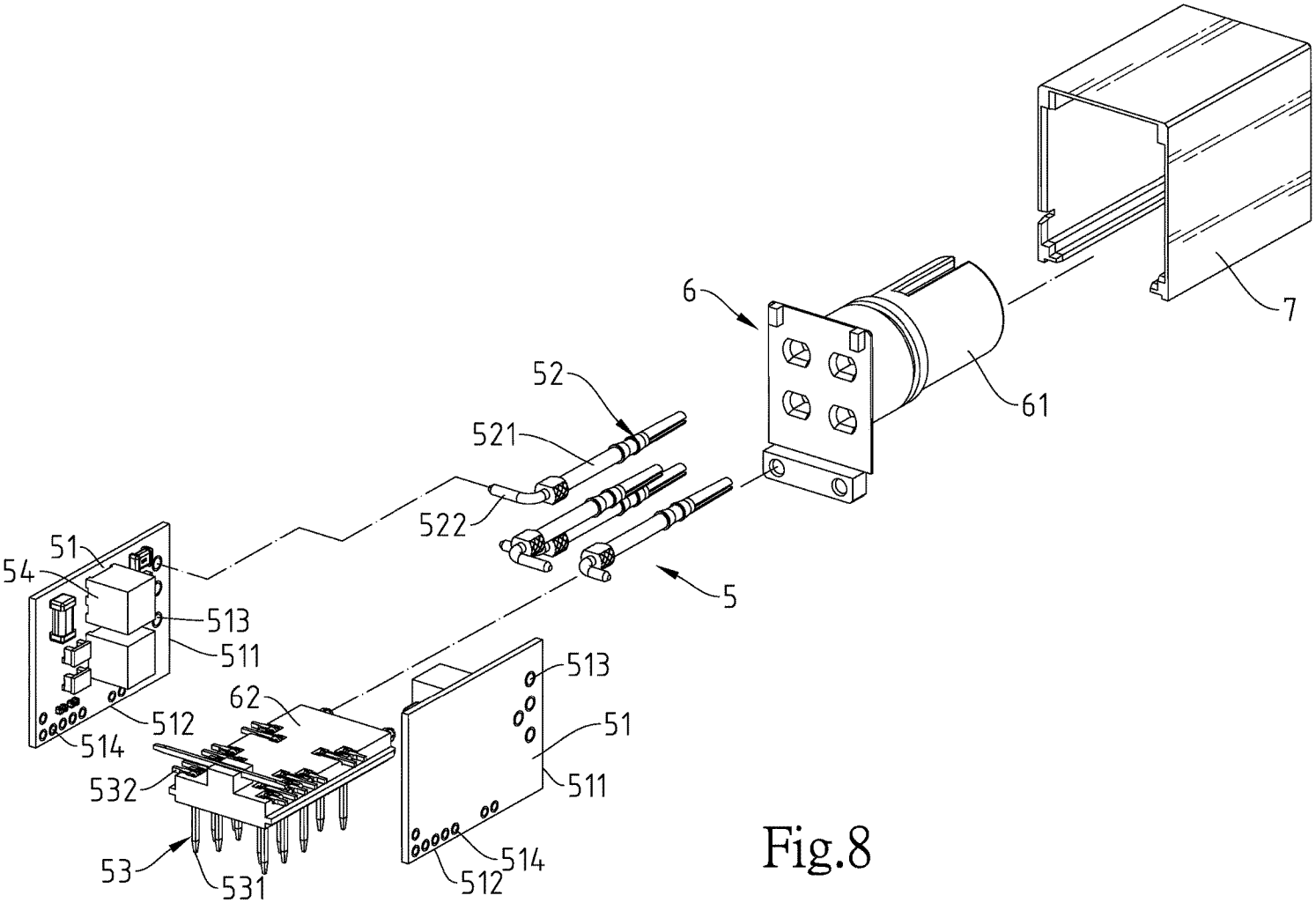
FIG. 8 corresponds to FIG. 7 when viewed from another angle.

Referring to FIGS. 6-8, a filter connector in accordance with a third embodiment of the present invention is shown. This third embodiment is substantially similar to the aforesaid first embodiment with the exceptions outlined hereinafter.

The electrical module 5 comprises a plurality of circuit boards 51 arranged in parallel; the input bonding ends 522 of the input terminals 52 are respectively bonded to the first lateral sides 511 of the circuit boards 51; the output bonding ends 532 of the output terminals 53 are respectively bonded to the second lateral sides 512 of the circuit boards 51; in installation, similar to the aforesaid first embodiment, mount the input terminal bodies 521 and output terminal bodies 531 of the electrical module 5 in the docking head 61 and base member 62 of the insulative housing 6, and then mount the insulative housing 1 in the shielding shell 7 to expose the docking head 61 outside the shielding shell 7.

What the invention claimed is:

1. A filter connector, comprising:

an insulative housing comprising a docking head and a base member at one side of the docking head; and an electrical module comprising at least one circuit board, a plurality of input terminals and a plurality of output terminals, each said circuit board comprising a first lateral side and a second lateral side disposed adjacent to each other, each said input terminal comprising an input terminal body and an input bonding end curved from one end of said input terminal, said input bonding end being bonded to the said first lateral side of one said circuit board to keep the associating said input terminal body in parallel to the said second lateral side of the respective said circuit board, each said output terminal comprising an output terminal body and an output bonding end curved from one end of said output terminal body, said output bonding end being bonded to the said second lateral side of one said circuit board to keep the associating said output terminal body in parallel to the said first lateral side of the respective said circuit board, the said input terminal bodies of said input terminals of said electrical module and the said output terminal bodies of said output terminals of said electrical module being respectively mounted in said docking head and said base member of said insulative housing.

2. The filter connector as claimed in claim 1, further comprising a shielding shell assembly surrounding said insulative housing to expose said docking head to the outside, wherein said insulative housing further comprises a top cover covered on a top side of said base member, and a side cover covered on a back side of said base member remote from said docking head.

3. The filter connector as claimed in claim 1, wherein said electrical module further comprises a plurality of electronic components mounted on said at least one circuit board.

4. The filter connector as claimed in claim 1, wherein said electrical module comprises a plurality of said circuit boards arranged in parallel; said input bonding ends of said input terminals are respectively bonded to the said first lateral sides of said circuit boards; said output bonding ends of said output terminals are respectively bonded to the said second lateral sides of said circuit boards.

* * * * *